United States Patent [19]

Preece

[11] 4,403,164

[45] Sep. 6, 1983

[54] SLIDING CONTACT ASSEMBLIES FOR ROTARY ELECTRIC MACHINES

[75] Inventor: Kenneth Preece, Solihull, England

[73] Assignee: Lucas Industries Limited, Birmingham, England

[21] Appl. No.: 338,148

[22] Filed: Jan. 8, 1982

[30] Foreign Application Priority Data

Jan. 15, 1981 [GB] United Kingdom ..... 8101199

[51] Int. Cl.[3] ..... H01R 39/08

[52] U.S. Cl. ..... 310/232

[58] Field of Search ..... 310/143, 232, 231, 219, 310/233, 238

[56] References Cited

U.S. PATENT DOCUMENTS 3,564,168 2/1971 Bigg et al. ..... 310/232

FOREIGN PATENT DOCUMENTS 2400269 3/1979 France ..... 310/232

*Primary Examiner*—Donovan F. Duggan
*Assistant Examiner*—Anita M. Ault

[57] ABSTRACT

A pair of brushes respectively slidably engage radially outer surfaces of first and second electrically conductive rings which are disposed co-axially and are rotatable about their common axis. The first ring surrounds an axial portion of the second ring and is electrically insulated therefrom by a thin layer of insulating material, while the second ring is mounted on a rotary shaft and is electrically insulated therefrom similarly by a thin layer of insulating material. The second ring may be axially stepped so that it has a smaller diameter portion which is surrounded by the first ring and a larger diameter portion which is engaged by the respective brush.

12 Claims, 4 Drawing Figures

SLIDING CONTACT ASSEMBLIES FOR ROTARY ELECTRIC MACHINES

This invention relates to sliding contact assemblies, primarily for a rotary electric machine.

According to the present invention, there is provided a sliding contact assembly comprising first and second electrically conductive rings disposed co-axially and rotatable about their comman axis, and a pair of brushes in sliding contact with the radially outer surfaces of the rings respectively, the first ring surrounding and being electrically insulated from an axial portion of the second ring.

Preferably, the first ring is approximately half the axial length of the second ring.

In one particular construction, the second ring is axially stepped so that it has a smaller diameter portion which is surrounded by the first ring and a larger diameter portion which is in sliding contact with the respective brush.

The present invention will now be further described, by way of example, with reference to the accompanying drawings, in which.

Figure 1:
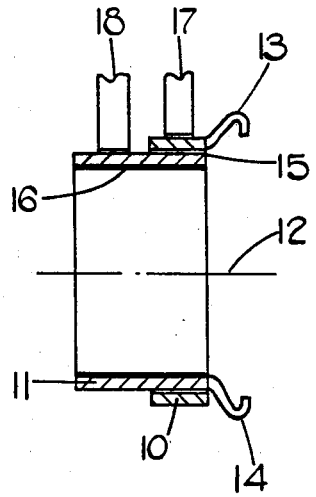
FIG. 1 is an axial sectional view of a first embodiment of a sliding contact assembly for a rotary electric machine according to the present invention.
Figure 2:
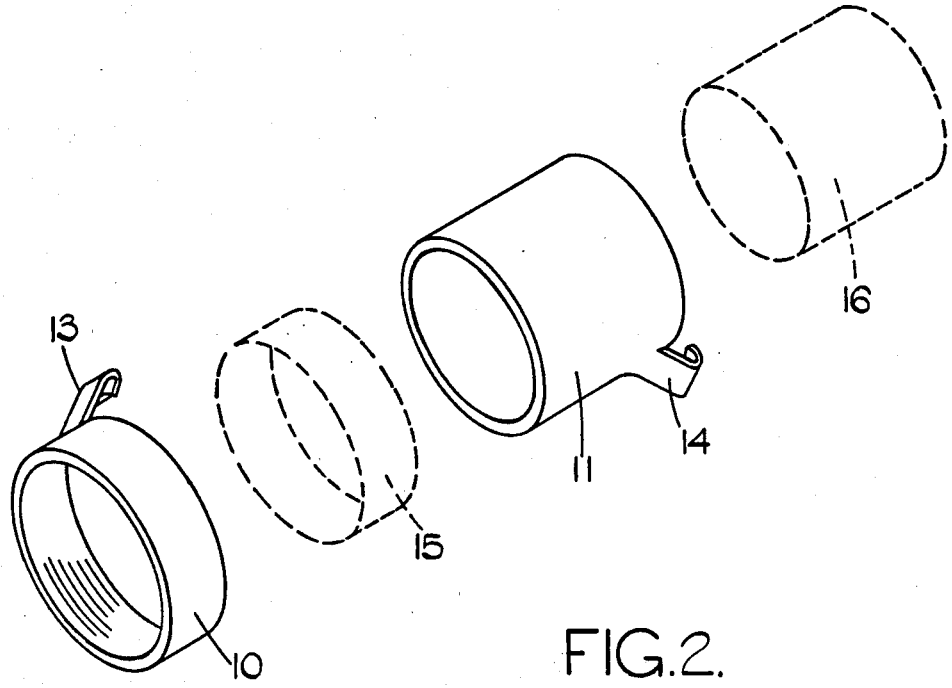
FIG. 2 is an exploded perspective view of the sliding contact assembly shown in FIG. 1.

Referring first to FIGS. 1 and 2, the sliding contact assembly shown therein comprises a pair of electrically conductive rings 10 and 11 which are mounted co-axially on a shaft (not shown) of a rotary electric machine for rotation about a common axis 12. The ring 10 is of slightly greater diameter than the ring 11 and approximately half the axial length of the latter, and is mounted so that it surrounds an axial portion of the ring 11. The rings are respectively provided with tags 13 and 14 whereby external electrical connections can be made thereto, for example from armature windings of the machine. The tags can be integral with the rings or can be welded-on. The rings are preferably angularly oriented so that the tags 13 and 14 lie diametrically opposite one another in the finished assembly.

A thin annular layer 15 of electrically insulating material is interposed between the rings 10 and 11 to insulate the latter from one another, and a similar but longer annular layer 16 is provided internally of the ring 11 to insulate the latter from the shaft. The layers 15 and 16 may be provided as a coating on the rings, or may be in the form of separate pieces of insulating tubing. In a particular example, the layers are formed by adhesive which also serves to secure the various components together.

A pair of brushes 17 and 18 (not shown in FIG. 2) are in sliding contact with the radially outer surfaces of the rings 10 and 11 respectively, to enable electricity to be supplied to the rotary parts of the machine in a conventional manner.

In order to facilitate assembly of the above construction, the ring 10 can be an interference fit on the ring 11, and the latter can itself be made an interference fit on the shaft. Whether or not such an interference fit is provided, the whole assembly is preferably secured together by expanding the shaft or by radially contracting the rings mechanically or magnetically. Advantageously, the rings are contracted by a magnetic setting operating using a MAGNEFORM machine, for example. After the various parts have been secured together, the rings can be machined so that their radially outer surfaces are accurately concentric with the axis 12.

Figure 3:
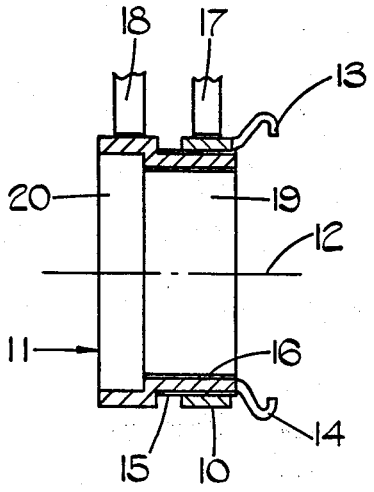
FIG. 3 is a similar view to FIG. 1 but showing a second embodiment of the sliding contact assembly.
Figure 4:
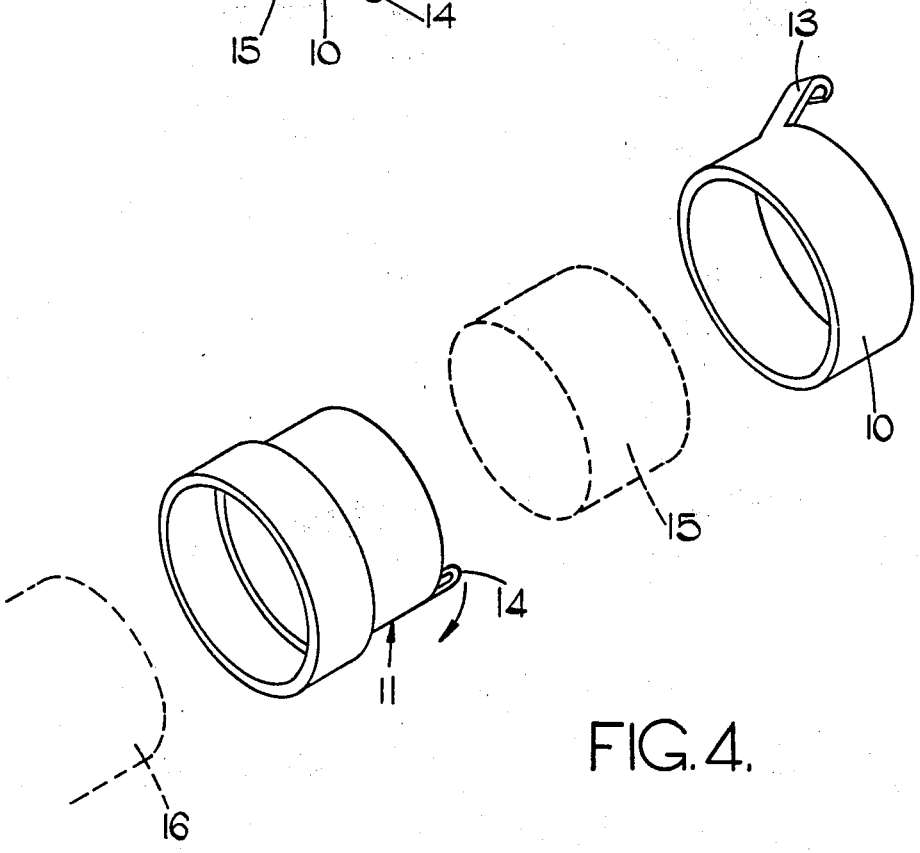
FIG. 4 is an exploded perspective view of the sliding contact assembly shown in FIG. 3.

In the above-described construction, the radially outer surfaces of the rings 10 and 11 where they are contacted by the brushes 17 and 18 are of different diameters. FIGS. 3 and 4 show an arrangement wherein these surfaces are of substantially the same diameter. More particularly, the ring 11 is now axially stepped so that it has a smaller diameter portion 19 which is surrounded by the ring 10 and a larger diameter portion 20 whose radially outer surface is contacted by the respective brush 18, the outer surface of the portion 20 being of approximately the same diameter as the outer surface of the ring 10.

The sliding contact assemblies described above are very simple in construction and have only a small number of component parts, making their assembly simple and cheap. More particularly, the present construction utilises only two conductive components, whereas most conventional constructions use at least three. There are also no problems of joining one of the slip rings to a conductive carrier with the resultant risk of a bad electrical contact therebetween, since in the present assembly the slip ring forms an integral part of what would otherwise be the carrier. Moreover, there is no need to provide an insulating moulding for mounting the rings, as is often the case with conventional sliding contact assemblies, and therefore the problems attendant on the production of such a moulding are avoided.

I claim:

1. A sliding contact assembly comprising a first cylindrical electrically conductive ring having a radially outer surface, a second cylindrical electrically conductive ring having a radially outer surface and an axial cylindrical portion which is concentrically surrounded and enclosed by said first cylindrical ring so that said rings are in overlapping relationship with each other to form an annular section, said first and second rings being co-axial with respect to an axis about which they are rotatable, means located in the annular section electrically insulating said first and second rings from each other, and a pair of brushes in sliding contact with said radially outer surfaces of said first and second rings, respectively.

2. The sliding contact assembly according to claim 1, wherein said first ring has an axial length which is approximately half that of said second ring.

3. The sliding contact assembly according to claim 1, wherein said second ring is axially stepped and comprises a smaller diameter portion and a larger diameter portion, said smaller diameter portion being surrounded by said first ring and said larger diameter portion being slidably engaged by a respective one of said brushes.

4. The sliding contact assembly according to claim 1, wherein said electrically insulating means comprises a thin annular layer of electrically insulating material which is interposed between said first and second rings.

5. The sliding contact assembly according to claim 4, wherein said thin annular layer is provided as a coating on one of said first and second rings.

6. The sliding contact assembly according to claim 4, wherein said thin annular layer is in the form of a piece of electrically insulating tubing.

7. The sliding contact assembly according to claim 4, wherein said thin annular layer is formed by adhesive which secures said first and second rings together.

8. The sliding contact assembly according to claim 1, further comprising a rotatable shaft on which said second ring is mounted for rotation therewith, and means electrically insulating said second ring from said rotatable shaft.

9. The sliding contact assembly according to claim 1, wherein said first and second rings are provided with respective tags whereby external electrical connections can be made thereto.

10. The sliding contact assembly according to claim 9, wherein said tags are formed integrally with said first and second rings, respectively.

11. The sliding contact assembly according to claim 9, wherein said tags are welded onto said first and second rings, respectively.

12. The sliding contact assembly according to claim 9, wherein said tags lie diametrically opposite each other with respect to said axis.

* * * * *